United States Patent [19]

Hosoya

[11] 4,106,276

[45] Aug. 15, 1978

[54] NON-ROTATING ROPE

[75] Inventor: Kiyoshi Hosoya, Tokyo, Japan

[73] Assignee: Tokyo Rope Mfg. Co. Ltd., Tokyo, Japan

[21] Appl. No.: 732,337

[22] Filed: Oct. 14, 1976

[51] Int. Cl.[2] ..... D07B 1/08

[52] U.S. Cl. ..... 57/147; 57/145

[58] Field of Search ..... 57/9, 139, 145–147, 57/161

[56] References Cited

U.S. PATENT DOCUMENTS

| | | | |
|---|---|---|---|
| 370,221 | 9/1887 | Tilghman | 57/146 |
| 975,541 | 11/1910 | Leschen | 57/147 |
| 2,176,422 | 10/1939 | Howell | 57/149 |
| 2,372,142 | 3/1945 | Warren | 57/147 |
| 3,097,472 | 7/1963 | Stirling | 57/145 X |
| 3,251,178 | 5/1966 | Stirling | 57/15 |
| 3,457,718 | 7/1969 | Otto et al. | 57/145 X |

FOREIGN PATENT DOCUMENTS

| | | | |
|---|---|---|---|
| 685,046 | 6/1930 | France | 57/9 |
| 1,008,156 | 5/1957 | Fed. Rep. of Germany | 57/146 |
| 1,134,004 | 7/1962 | Fed. Rep. of Germany | 57/147 |
| 366,823 | 5/1931 | United Kingdom | 57/9 |
| 447,871 | 5/1936 | United Kingdom | 57/9 |

*Primary Examiner*—Donald Watkins

[57] ABSTRACT

A non-rotating rope, comprising 3 or 4 strands of of clam-shaped cross section so arranged around a flexible core equidistantly from the rope center that the principal axes of the clams are on the equiangularly spaced radial lines radiating from the rope center and the sides of the clams are in contact with one another with the apex and base of each clam directed inwards and outwards respectively, is closed in a direction opposite to the direction of the lay of the strands.

4 Claims, 7 Drawing Figures

NON-ROTATING ROPE

BACKGROUND OF THE INVENTION

This invention relates to a non-rotating rope. A conventional non-rotating rope, which may be used with cranes or the like, is composed of a plural layers of strands contra-laid over another in an effort to equalize the opposing torques in the various layers of strands, and thus produce ropes which are as free from the tendency to rotate under the load as possible, that is to say, in an effort to off-set the rightward torque of a layer of left-hand lay strands (No. 1) by the leftward torque of a layer of right-hand lay strands (No. 2) which may be yielded due to the unspinning tendency of any rope when any load is applied thereto. If such a rope composed of at least two layers of different lay direction of strand is positively spun by the external force, one layer will be unspun, while the other (or another) layer will be further spun. In the unspun layer the wires or strands forming the same will be loosened, while in the spun layer deformation of the rope will be caused by the tension or wires or strands, so that the balance between the said layers may be lost to allow the springing of strands away from the innet layer or birdcage like deformation of the rope may be caused

SUMMARY OF THE INVENTION

Therefore, the primary object of the present invention is to provide a non-rotating rope which is free from the aforementioned deformation.

Another object of the present invention is to provide a non-rotating rope which is so constructed that when the said rope and a sheave are brought into contact with each other, the contact area between the said rope and sheave is large enough or the pressure per unit area is low enough to enhance the wear resistance.

Still another object of the present invention is to provide a non-rotating rope which is easy to handle.

According to the present invention, the aforesaid objects will be attained by a clam-shaped strand non-rotating rope in which 3 or 4 strands, each composed of plural layers of wires stranded in the same direction around a core made of flexible material, such as fibre (natural or synthetic), are arranged in a single layer around the periphery of a core made of the same material as that of the aforesaid core and closed in a direction opposite to the direction of lay of said strands, which have clam-shaped sections in the planes normal to the rope axis and principal axes on the equangularly spaced radial lines, and are so disposed equidistantly from the rope centre as to be in contact with one another at each side thereof with the apex and base of each clam directed inwards and outwards respectively.

Further objects and advantages of the present invention will be apparent from the following detailed description of the present invention made with reference to the accompanying drawings.

DESCRIPTION OF PREFERRED EMBODIMENT

Figure 1:
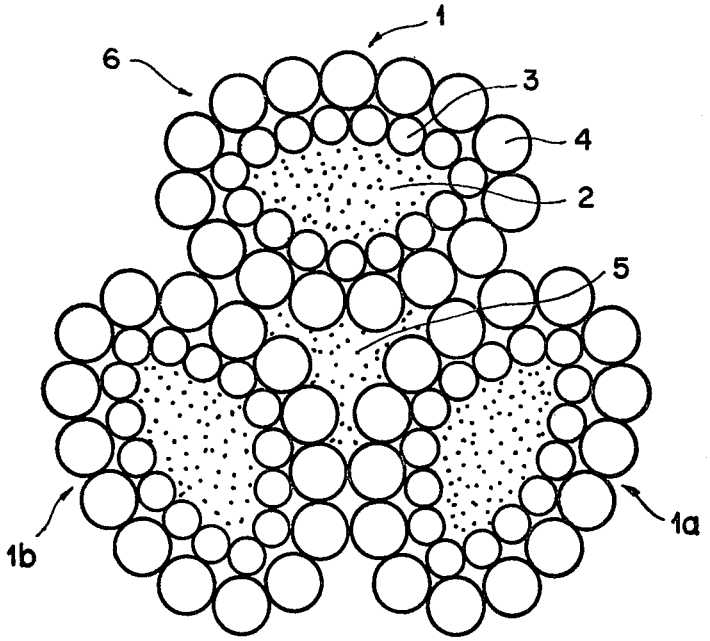
FIG. 1 is a cross section of a preferred embodiment of the present invention of 3-clam-strands-type non-rotating rope.

FIG. 1 shows a cross section of a first preferred embodiment of the invention. The clam-shaped strand 1, composed of 15 inner layer wires 3 arranged around the hemp core 2 and 15 outer layer wires 4 with the diameter larger than that of said inner layer wire arranged around the hemp core 2 and 15 outer layer wires 4 with the diameter larger than that of said inner layer wire arranged around said inner layer wires, is stranded together with the line contact lay and formed into a clam-like shape. A single-layer rope 6 may be formed by closing in a direction opposite to the direction of lay of said strand around the hemp core 5, said three strands 1, 1*a*, and 1*b* which are so arranged equidistantly from the rope centre that the principal axes of the clams are on the 3 equiangularly spaced radial lines radiating from the rope centre and said three strands are in contact with one another at each side thereof with the apex and base of each clam directed inwards and outwards respectively. In doing this, the moment of rotation of the rope itself may be reduced by closing together the strands and rope in such a manner as to provide the pitch ratio of each strand and the rope of e.g. 1 : 1.75.

Figure 2:
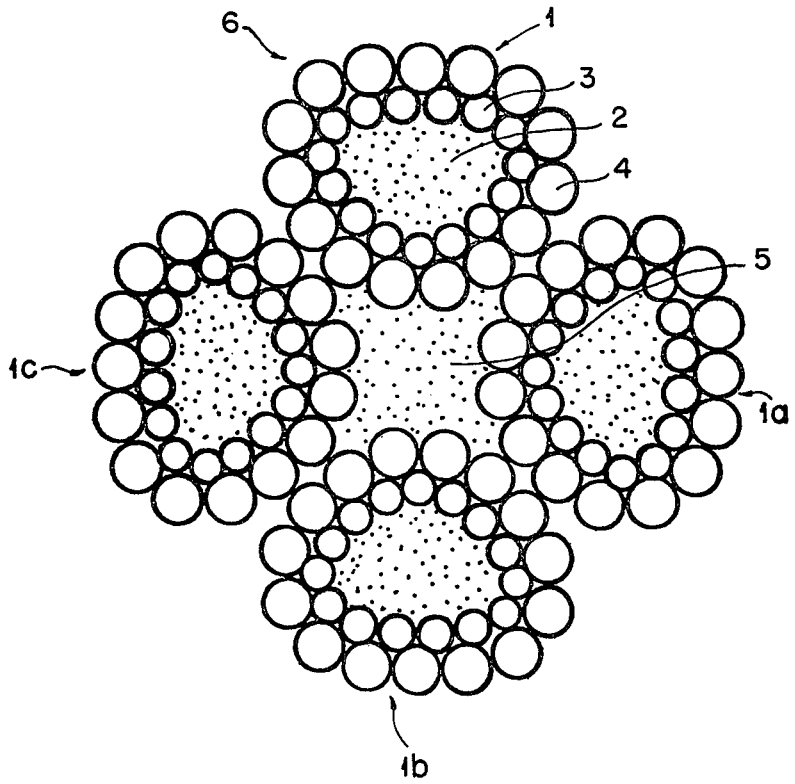
FIG. 2 is a cross section of another preferred embodiment of the present invention of 4-clam-strands-type non-rotating rope.

FIG. 2 shows a second preferred embodiment of the present invention. The clam-shaped strand 1, composed of 15 inner layer wires 3 arranged around the hemp core 2 and 15 outer layer wires 4 with the diameter larger than that of said inner layer wire arranged around said inner layer wires, is stranded together with the line contact lay and formed into a substantially clam-like shape. A single layer rope 6 may be formed by closing in a direction opposite to the direction of lay of said strand around the hemp core 5 said four strands 1, 1*a*, 1*b* and 1*c* which are so arranged equidistantly from the rope centre that the principal axes of the clams are on the 4 equiangularly spaced radial lines radiating from the rope centre and said four strands are in contact with one another at each side thereof with the apex and base of each clam directed inwards and outwards respectively. In doing this, the moment of rotation of the rope itself may be reduced by closing together the strands and rope in such a manner as to provide the pitch ratio of each strand and the rope of e.g. 1 : 1.75. The aforementioned two wire ropes composed of clam-shaped strands, having flat outer surface, will provide larger contact area with the sheave or lower pressure per unit area as compared with the round-stranded rope, thereby enhancing the wear resistance.

Now I will calculate the tangential components $T_s$ and $T_w$ of the axial load W per strand and per wire respectively of the rope of the present invention in the plane perpendicular to the rope axis. For ease of explanation, it will be assumed that each strand should comprise two layers and the numbers of the wires in such layers should be $m1$ and $m2$ for the inner layer and outer layer respectively.

$$Ts = \frac{W}{n} \cdot \frac{1}{\tan \alpha} \quad (1)$$

$$Tw1 = \frac{W}{n \times m1} \cdot \frac{1}{\tan \beta_1} \times A1 \quad (2)$$

$$Tw2 = \frac{W}{n \times m2} \cdot \frac{1}{\tan \beta_2} \times A2 \quad (3)$$

where $w$: Rope load $\alpha$: Angle of lay of the strand in the rope $\beta_1$: Angle of lay of the wire of the inner layer of the strand $\beta_2$: Angle of lay of the wire of the outer layer of the strand $n$: Number of the strand in the rope $m$: Number of the wire in each layer of the strand area of each outer layer wire is $a2$, the distances respectively between the centres of the inner wires and the rope centre 0 are $r1$, $r1,2 \ldots r1$, 15, and the distances respectively between the centres of the outer wires and the rope centre 0 are $r2,1$, $r2,2 \ldots r2,15$:

$$Rw1 = \frac{r1,1 + r1,2 + \ldots + r1,15}{15}$$

$$Rw2 = \frac{r2,1 + r2,2 + \ldots + r2,15}{15}$$

$$Rs = \frac{Rw1\,(a1 \times 15) + Rw2\,(a2 \times 15)}{(a1 \times 15) + (a2 \times 15)} + \frac{Rw1 \cdot a1 + Rw2 \cdot a2}{a1 + a2}$$

The calculated value of the moment of rotation caused by the normal load W on the clam-shaped strand ropes (FIGS. 1 and 2) and the round-strand ropes (FIGS. 3 to 6) of the same effective cross-sectional area is as follows: where $$\left\{\begin{array}{l} \tan \alpha 1 = 5.4 \\ \tan \beta 1 = 3.7 \\ \tan \beta 2 = 2.6 \end{array}\right. \quad \left\{\begin{array}{l} A1 = 0.36 \\ A2 = 0.64 \end{array}\right. \quad \text{(from the drawings)}$$

Figure 3:
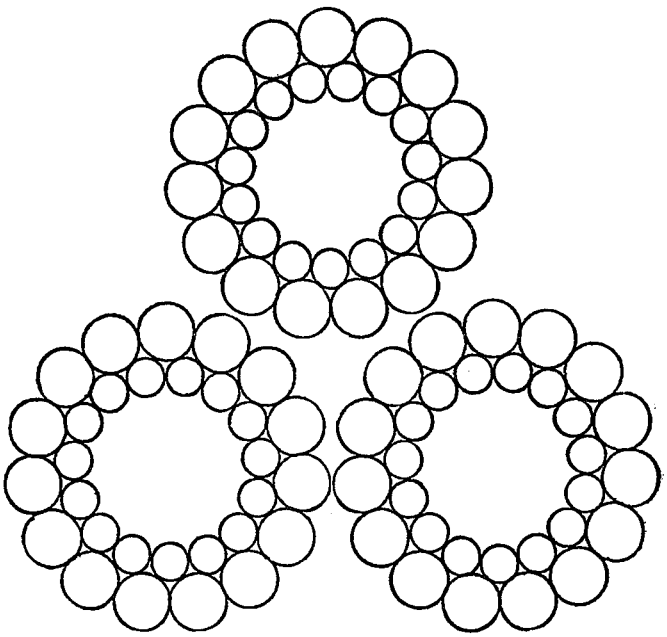
FIG. 3 is a cross section of a 3-round-strands rope which has the same effective area as that of the rope of FIG. 1.
Figure 4:
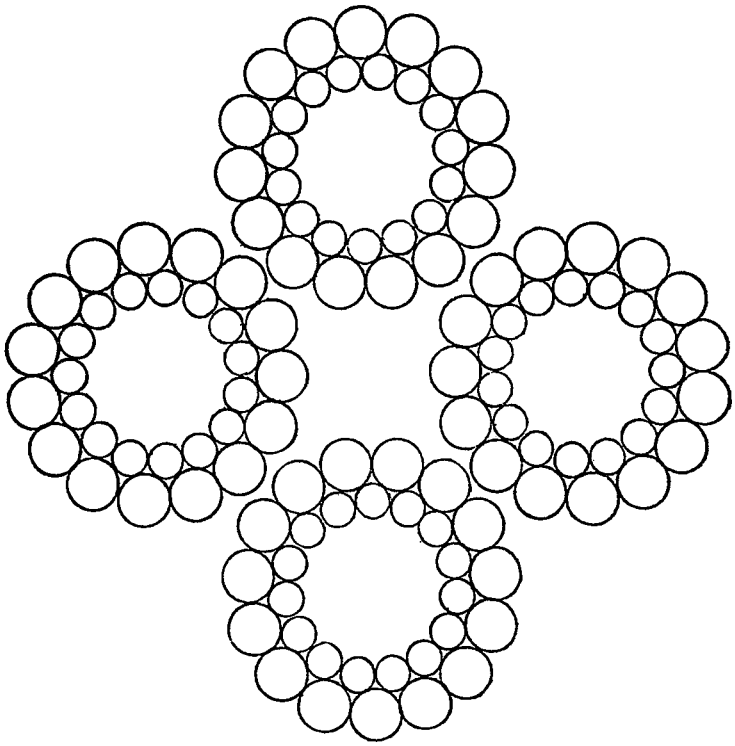
FIG. 4 is a cross section of a 4-round-strands rope which has the same effective area as that of the rope of FIG. 1.
Figure 5:
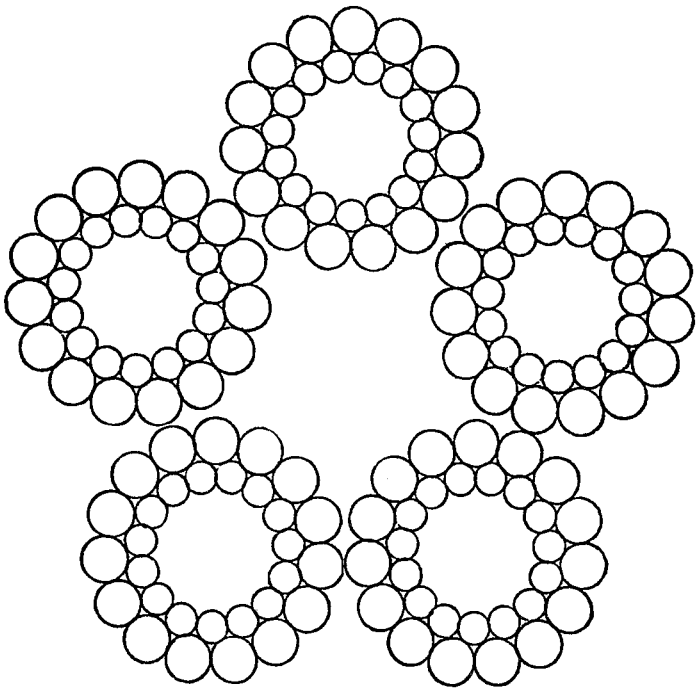
FIG. 5 is a cross section of a 5-round-strands rope which has the same effective area as that of the rope of FIG. 1.
Figure 6:
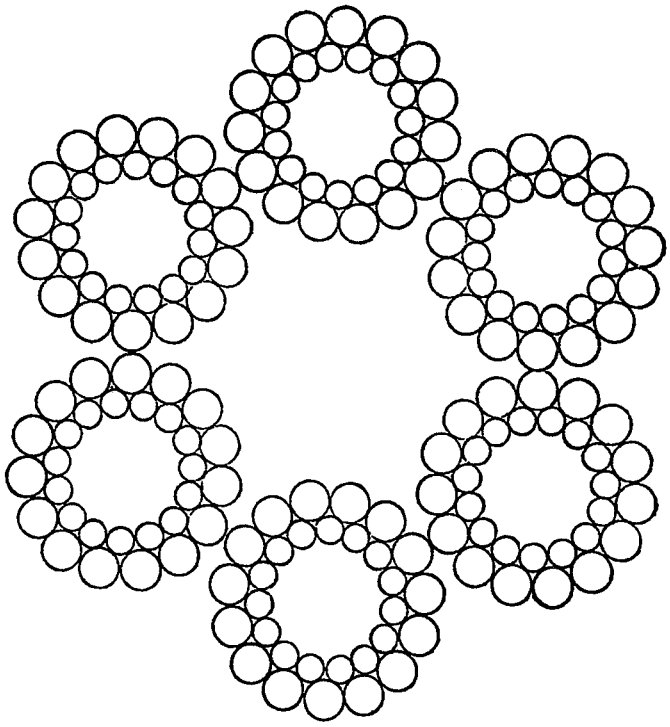
FIG. 6 is a cross section of 6-round-straps rope which has the same effective area as that of the rope of FIG. 1.
Figure 7:
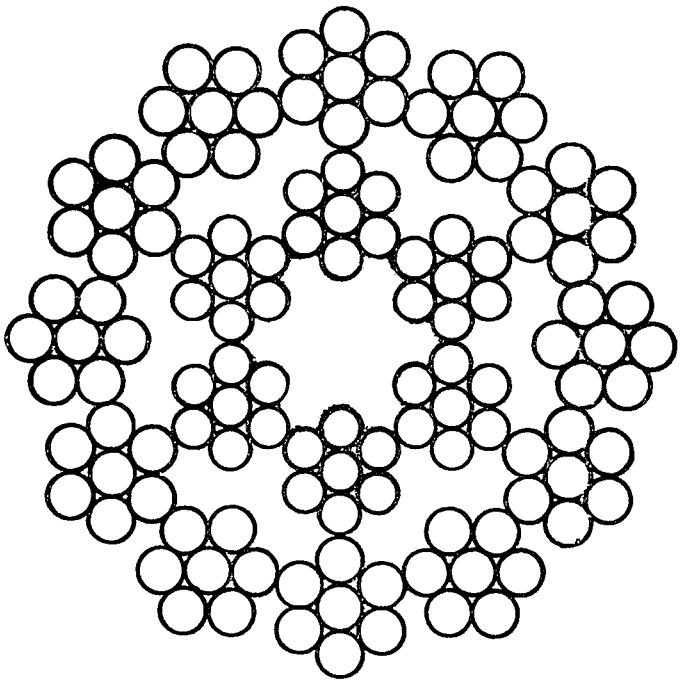
FIG. 7 is a cross section of a conventional non-rotating rope.

| | clam-shaped strand rope | | round strand rope | | | |
|---|---|---|---|---|---|---|
| | FIG. 1 | FIG. 2 | FIG. 3 | FIG. 4 | FIG. 5 | FIG. 6 |
| n | 3 | 4 | 3 | 4 | 5 | 6 |
| D | 0.881D | 0.882D | 1.016D | 0.986D | 0.985D | 1.000D |
| Rs | 0.236D | 0.258D | 0.272D | 0.288D | 0.311D | 0.333D |
| Rw1 | 0.120D | 0.120D | 0.139D | 0.120D | 0.107D | 0.098D |
| Rw2 | 0.171D | 0.170D | 0.197D | 0.170D | 0.152D | 0.139D |
| Ts (formula 1) | 0.090W | 0.068W | 0.090W | 0.068W | 0.054W | 0.045W |
| Tw1 (formula 2) | 0.0022W | 0.0016W | 0.0022W | 0.0016W | 0.0013W | 0.0011W |
| Tw2 (formula 3) | 0.0055W | 0.0041W | 0.0055W | 0.0041W | 0.0033W | 0.0027W |
| M (formula 4) | 0.0012DW | 0.0168DW | 0.0109DW | 0.025DW | 0.036DW | 0.046DW |

$Ts$: Tangential component of the load per strand in the plane perpendicular to the rope axis $Tw1/Tw2$: Tangential component of the load in the plane perpendicular to the rope axis per wire respectively in the inner layer and the outer layer of strand $A1$: Ratio of the total effective cross-sectional area of the inner layer wire to the total effective cross-sectional area of the rope $A2$: Ratio of the total effective cross-sectional area of the outer layer wire to the total effective cross-sectional area of the rope The angle of lay of the strand is opposite to that of the wire in the strand, so that the total moment M which is to be caused by all the strands and all the wires around the rope axis, according to the aforesaid tangential components of the load, is:

$$M = n \times Ts \times Rs - n \times m1\ Tw1\ Rw1 - n\ m2 \times Tw2\ Rw2 \quad (4)$$

where $Rs$: Pitch radius of the strand $Rw1$: Pitch radius of the inner layer $Rw2$: Pitch radius of the outer layer The method of calculating these values will now be described taking the rope shown in FIG. 2 as an example. In FIG. 2, where the cross-sectional area of each inner layer wire of a strand is $a1$, the cross-sectional By comparing the above-listed value of M in the columns for FIGS. 1 and 3 and the columns for FIGS. 2 and 4, it is apparent that the M value of the clam-strand rope is smaller than that of the round-strand rope of the same effective cross-sectional area, thereby indicating that the non-rotating property of the clam-strand rope of the present invention is improved.

Further, in the ropes of the same effective cross-sectional area, it is apparent from the comparison of the M value in the columns for FIGS. 3 to 6 that any increase in the number of strands $n$ will reduce the diameter of the strand itself and lengthen the pitch radius of the layer to augment the M value. Further, it is also apparent that where $n = 2$, the shape of the rope will be unstable; while where $n = 5$, the M value will be much larger as compared with the case where $n = 3$ or 4. Such is a comparison of the clam-shaped strand with the round strand on the M value varying with $n$, while the variation of M according to the variation of $n$ of the clam-shaped strands will be deemed as proportional to that of the corresponding round strand, so that the number of strands $n$ of the clam-shaped-strand rope of the present invention is limited to 3 or 4.

Accordingly, the rope in accordance with this invention, if used as a high lift one part hoisting line for heavy goods, will be able to secure quite stable operation due to its non-rotational property under the load. The cores for strand and rope may not always be made of hemp but of any flexible and deformable material, such as natural fibre, synthetic fibre or soft metal such as aluminium.

It will be understood from the above description that this invention is not limited to the foregoing embodiments but can be applied in various modifications without departing from the object and scope of the invention.

What is claimed is:

1. A clam-shaped-strand non-rotating rope in which three strands, each composed of plural layers of wires stranded in the same direction around a core made of flexible material, are arranged in a single layer around the periphery of a core made of the same material as that of said core and closed in a direction opposite to the direction of lay of said strands, which have clam-shaped sections in the planes normal to the rope axis and principal axes on the equiangularly spaced radial lines, and which are so disposed equidistantly from the rope center as to be in contact with one another at each side thereof with the apex and base of each clam directed inwards and outwards respectively thereby reducing the pitch radius $R_s$ of each strand and making the rotational moment $M_w$ of the wires of each strand approximate the rotational moment $M_s$ of the strand, said rope further defined by having a relatively small pitch radius and individual strands making up the rope have relatively small pitch radii.

2. A clam-shaped-strand non-rotating rope in which four strands, each composed of plural layers of wires stranded in the same direction around a core made of flexible material, are arranged in a single layer around the periphery of a core made of the same material as that of said core and closed in a direction opposite to the direction of lay of said strands, which have clam-shaped sections in the planes normal to the rope axis and principal axes on the equiangularly spaced radial lines, and which are so disposed equidistantly from the rope center as to be in contact with one another at each side thereof with the apex and base of each clam directed inwards and outwards respectively thereby reducing the pitch radius $R_s$ of each strand and making the rotational moment $M_w$ of the wires of each strand approximate the rotational moment $M_s$ of the strand, said rope further defined by having a relatively small pitch radius and individual strands making up the rope have relatively small pitch radii.

3. A clam-shaped-strand non-rotating rope claimed in claim 1 in which the flexible material is one selected from the group consisting of natural fibre, synthetic fibre and filament of soft metal.

4. A clam-shaped-strand non-rotating rope claimed in claim 2 in which the flexible material is one selected from the group consisting of natural fibre, synthetic fibre and filament of soft metal.

* * * * *